US007847704B2

(12) United States Patent
Wagner et al.

(10) Patent No.: US 7,847,704 B2
(45) Date of Patent: Dec. 7, 2010

(54) METHOD AND DEVICE FOR TRANSMITTING SIGNALS FROM A POSITION MEASURING ARRANGEMENT TO AN EVALUATION UNIT

(75) Inventors: Johannes Wagner, Taching/Tengling (DE); Elmar Mayer, Nuβdorf (DE)

(73) Assignee: Dr. Johannes Heidenhain GmbH, Traunreut (DE)

( * ) Notice: Subject to any disclaimer, the term of this patent is extended or adjusted under 35 U.S.C. 154(b) by 330 days.

(21) Appl. No.: 12/217,850

(22) Filed: Jul. 9, 2008

(65) Prior Publication Data

US 2009/0015423 A1 Jan. 15, 2009

(30) Foreign Application Priority Data

Jul. 12, 2007 (DE) ..... 10 2007 033 009

(51) Int. Cl.
*G08B 21/00* (2006.01)

(52) U.S. Cl. ..... 340/680; 340/679; 340/524; 340/686.1; 700/192

(58) Field of Classification Search ..... 340/679, 340/680, 524, 686.1, 686.2, 689, 506, 531; 700/186–193

See application file for complete search history.

(56) References Cited

U.S. PATENT DOCUMENTS 5,905,350 A 5/1999 Hofbauer et al.
2003/0016369 A1 1/2003 Benner et al.

FOREIGN PATENT DOCUMENTS

DE 196 39 316 A1 3/1998
EP 1 271 107 A1 1/2003

*Primary Examiner*—George A Bugg
*Assistant Examiner*—Hongmin Fan
(74) *Attorney, Agent, or Firm*—Brinks Hofer Gilson & Lione

(57) ABSTRACT

A method for transmitting signals from a position measuring arrangement to an evaluation unit, the method including transmitting position signals, reference pulses, and warning signals indicating a malfunction state from a position measuring arrangement for determining the position of two elements of a machine which are movable relative to each other, to an evaluation unit. The method further includes logically interconnecting the reference pulses with the position signals in such a way that, in a malfunction-free state, a valid status combination for outputting the reference pulses and an invalid status combination for outputting the reference pulses appear in each period. The method including transmitting warning signals indicating a malfunction state during the invalid status combination of the position signals and the reference pulses which, in the malfunction-free state, is invalid for outputting the reference pulses.

18 Claims, 3 Drawing Sheets

METHOD AND DEVICE FOR TRANSMITTING SIGNALS FROM A POSITION MEASURING ARRANGEMENT TO AN EVALUATION UNIT

RELATED APPLICATIONS

Applicants claim, under 35 U.S.C. §119, the benefit of priority of the filing date of Jul. 12, 2007 of a German patent application, copy attached, Serial Number 10 2007 033 009.1, filed on the aforementioned date, the entire contents of which is incorporated herein by reference.

BACKGROUND

1. Technical Field

The present invention relates to a method for transmitting position signals and reference pulses, as well as warning signals indicating a malfunction state, from a position measuring arrangement for determining the position of two elements of a machine which are movable relative to each other, to an evaluation unit. The present invention further relates to a device for transmitting substantially rectangular-shaped position signals and reference pulses, as well as warning signals indicating a malfunction state, from a position measuring arrangement for determining the position of two elements of a machine which are movable relative to each other, to an evaluation unit.

2. Background Information

A position measuring arrangement is used for the determination of the position of two objects which can be moved in relation to each other, for example two machine parts of a machine tool which can be moved in relation to each other. A measurement representation, for example in the form of a scale graduation, is connected with the one of the two objects, and a scanning unit with the other, so that, by scanning the scale graduation, it becomes possible to determine the extent of the movement of the two objects with respect to each other along the scale graduation. In this case the generation of position signals by the position measuring arrangement takes place by scanning, for example optical scanning, of the scale graduation by a measured value sensor of the position measuring arrangement in the course of the relative movement of the scanning unit and the scale graduation. By the scanning unit on the one hand, and the scale graduation on the other being arranged on one of the two objects which are movable with respect to each other, it is possible to detect the respective position of the one object in relation to the other object, either in the form of an absolute position, when employing a scale graduation constituted by a code track, or in the form of relative position changes, when employing an incremental periodic scale graduation. In this case the generation of the different types of position signals can take place by employing optical, magnetic, inductive or capacitive scanning units.

When using incremental position measuring arrangements for position measuring, at least two periodic analog position signals, which are phase-shifted in relation to each other, are generated at the output side by scanning a periodic scale graduation by a scanning unit which, for determining the relative position of the scale graduation and the scanning unit, are evaluated in an evaluation unit including, for example, of a numerical control of a machine tool.

The incremental position signals generated by the position measuring arrangement are transmitted, depending on the type of transmission, via two or four signal transmission lines in a parallel form to the downstream arranged evaluation unit. In the case of incremental position signals, in connection with the relative movement of the scale graduation and the scanning unit, the position measuring arrangement provides two position signals phase-shifted by 90° in a single-phase transmission. In case of a differential transmission, an inverted position signal is additionally transmitted from the position measuring arrangement to the evaluation unit with each one of the two 90° phase-shifted position signals.

In addition to the position signals and possibly inverted position signals, reference pulses are transmitted from the position measuring arrangement to the evaluation unit, which are generated by logically interconnecting reference pulse signals, derived from the scale graduation, with the position signals. In case of single-phase transmission, a reference pulse is transmitted via a further signal transmission line to the evaluation unit and is further processed there, while in case of a differential transmission two further signal transmission lines are provided, through which a reference pulse and an inverted reference pulse are transmitted.

Besides the incremental position signals and the reference pulses, a warning signal can be output by the position measuring arrangement to the evaluation unit if, for example, permissible signal amplitudes fall below a threshold, or other events occur which endanger a dependable operation and are detected by a monitoring unit, which is connected with the position measuring arrangement or is integrated into the position measuring arrangement and outputs the warning signal. For transmitting the warning signal from the position measuring arrangement to the evaluation unit, a single-phase signal which, in case of the transmission of rectangular-shaped warning signals with logical high and low levels, assumes a high level in the normal state, for example, while the warning state corresponds to a low level state, is transmitted to the evaluation unit via an additional output of the position measuring arrangement, as well as via an additional warning signal transmission line.

The disadvantage of this type of transmission of a warning signal is the requirement for a separate warning signal transmission line, which goes counter to the demand to keep the number of required signal transmission lines between the position measuring arrangement and the downstream-arranged evaluation unit as low as possible. Besides avoiding unnecessary outlay for wiring, it is intended to assure, if possible, the compatibility with the customary number of signal transmission lines when transmitting possibly desired additional signals.

For issuing warning signals it is alternatively possible to switch all outputs of the position measuring arrangement to high resistivity so that in the warning state instead of the differential signals only signals of the same level are present, which is recognized by the electronic follow-up device of the evaluation unit as a malfunction state. This way of transmitting a warning signal has the advantage that the warning signal does not require its own warning signal transmission line, and that it is additionally also possible to detect a line break in the warning signal transmission line, because in that case a low level is present at the follow-up device of the evaluation unit, which corresponds to a warning state. A substantial disadvantage of this type of transmission of a warning signal lies in that the transmission of signals is interrupted in the warning state, and the machine equipped with the position measuring arrangement must be immediately stopped.

OBJECTS AND SUMMARY OF THE INVENTION

It is an object of the present invention to disclose a method and a device of the type mentioned at the outset, which do not require any additional signal transmission lines for transmitting a warning signal and permit a transmission of position signals and reference pulses also in the warning state.

In accordance with the present invention, the above object is attained by a method for transmitting signals from a position measuring arrangement to an evaluation unit, the method including transmitting position signals, reference pulses, and warning signals indicating a malfunction state from a position measuring arrangement for determining the position of two elements of a machine which are movable relative to each other, to an evaluation unit. The method further includes logically interconnecting the reference pulses with the position signals in such a way that, in a malfunction-free state, a valid status combination for outputting the reference pulses and an invalid status combination for outputting the reference pulses appear in each period. The method including transmitting warning signals indicating a malfunction state during the invalid status combination of the position signals and the reference pulses which, in the malfunction-free state, is invalid for outputting the reference pulses.

The above object is further attained by a device for transmitting substantially rectangular-shaped position signals and reference pulses, as well as warning signals indicating a malfunction state, from a position measuring arrangement to an evaluation unit. The device includes a position measuring arrangement that determines a position of two elements of a machine which are movable relative to each other, the position measuring arrangement includes a scale graduation comprising an incremental graduation and reference markers, wherein scanning signals are generated from the incremental graduation and a logic unit. The logic unit outputs substantially rectangular-shaped phase-shifted, incremental position signals from the scanning signals and which generates a substantially rectangular-shaped reference pulse from the reference markers and said position signals in such a way that, in the malfunction-free state, valid status combinations and invalid status combinations for issuing the reference pulses occur in each period. The device further includes an evaluation unit that receives the position signals and the reference pulse from a signal transmission of the position measuring arrangement, wherein the logic unit inserts a warning signal into the signal transmission indicating a malfunction state during a status combination of the position signals and of the reference pulse which, in a malfunction-free state, is invalid for issuing the reference pulse. The evaluation unit includes a malfunction recognition unit which filters a warning signal, which was transmitted during a status combination of the position signals and the reference pulse which is invalid for an output of the reference pulse in the malfunction-free state, out of the signal transmission.

The attainments in accordance with the present invention do not require any additional signal transmission lines for transmitting a warning signal from the position measuring arrangement to the evaluation unit and therefore meet the requirement for keeping the outlay for required signal connections as low as possible and for assuring compatibility with the customary number of signal transmission lines. Moreover, the method in accordance with the present invention and the device in accordance with the present invention assure that the incremental position signals can continue to be transmitted in the warning state, so that the machine equipped with the position measuring arrangement need not be stopped immediately in case of the occurrence of a warning state.

The attainments in accordance with the present invention are based on the concept of using the warning signal, employing the existing signal transmission lines for the transmission of the position signals and reference pulses, preferably the signal transmission lines for the reference pulses, in connection with a single-phase transmission, or a differential transmission by using a status combination of the position signals and the reference pulses which, in normal operations is not valid for issuing the reference signal, for differentiating between a reference pulse and a warning signal indicating a warning state.

Preferably at least two substantially rectangular-shaped, phase-shifted, incremental position signals P1, P2 are generated from scanning signals of an incremental graduation of a scale graduation of the position measuring arrangement, analog reference pulse signals are derived from reference markers of the scale graduation, and rectangular-shaped basic reference pulses RI', which are, for a valid status combination, logically interconnected with the position signals P1, P2 to form reference pulses RI in accordance with the satisfaction of the condition $$[RI'=High] \text{ AND } [[P1 \text{ OR } P2]=HIGH].$$

When a malfunction state is detected, a basic warning signal WRN' is generated, which is logically interconnected with the position signals P1 and P2 and emitted as the warning signal WRN corresponding to the satisfaction of the condition $$[WRN'=HIGH] \text{ AND } [P1=P2=Low],$$

representing an invalid status combination.

Outputting the warning signal is possible both in case of a single-phase transmission and of a differential transmission wherein, with a single-phase transmission, two phase-shifted position signals and one reference pulse which, in malfunction-free normal operations, are logically interconnected with the phase-shifted position signals into periodically occurring valid status combinations, are transmitted from the position measuring arrangement to the evaluation unit, while in case of a differential transmission at least four incremental position signals, each with respectively two first position signals, phase-shifted by 90°, and two second position signals, inverted with respect to the first position signals, and respectively one first reference pulse signal which, in malfunction-free normal operations, are logically interconnected with the first position signals to form periodically occurring valid status combinations and respectively one second reference pulse signal which, in malfunction-free normal operations, is logically interconnected with the second position signals to form periodically occurring valid status combinations, are transmitted.

Since in connection with a slow advance and during the stoppage of the machine, for example when stopping a shaft of a machine tool at a defined position, it can happen that there will be no possibility of transmitting a warning signal from the position measuring arrangement to the evaluation unit over a prolonged period of time, because the status combination for invalid status combination P1=0 AND P2=0, which is invalid in normal operations for transmitting the warning signal for issuing the reference pulse RI, does not occur, in case of a slow advance or during the stop of the machine the time is determined which has elapsed since the last appearance of the status combination which is invalid for transmitting the reference pulse (RI), and when this period of time is exceeded and when a warning signal indicating a first malfunction state occurs, an alarm signal is transmitted. In this case the status combination, which is invalid for transmitting the reference pulse, is forced for transmitting the alarm signal, and the alarm signal is transmitted like a warning signal.

Since the evaluation unit detects the slow running, or respectively the stoppage of the machine by the transmission of the position signals and reference pulses, if being programmed accordingly, it values the transmission of warning signals in case of a slow advance, or respectively stoppage of the machine as an alarm signal, which leads to stopping the machine and/or requires an appropriate acknowledgement of the alarm signal. Following a manual acknowledgement and/or remedy of the malfunction state connected with the separate alarm report, the control returns to the normal state.

A device for transmitting substantially rectangular-shaped position signals and reference pulses, as well warning signals indicating a malfunction state, from a position measuring arrangement for determining the position of two elements of a machine which are movable relative to each other, via signal lines to an evaluation unit, wherein the position measuring arrangement has a logic unit, which outputs phase-shifted, incremental position signals from scanning signals from an incremental gradation of a scale graduation, and a reference pulse generated from reference markers of the scale graduation and the position signals, is distinguished in part by the logic unit. In particular, the logic unit generates the reference pulse RI from the phase-shifted, incremental position signals P1, P2 and from the reference markers of the scale graduation in such a way that, in the malfunction-free state, status combinations which are valid and those invalid for issuing reference pulses RI occur in each period, and inserts a warning signal WRN into the signal transmission from the position measuring arrangement to the evaluation unit indicating a malfunction state in the course of a status combination of the position signals P1, P2 and of the reference pulse RI which, in the malfunction-free state, is invalid for issuing the reference pulse RI, and that the evaluation unit has a malfunction recognition unit which filters the warning signal WRN, which was transmitted in the course of a status combination of the position signals P1, P2 and the reference pulse RI which is invalid for the output of the reference pulse RI in the malfunction-free state, out of the signal transmission.

Preferably the condition [RI=High] AND [P1=P2=Low] applies as invalid status combination of the position signals P1 and P2 and the reference pulse RI. However, alternatively any other status combination of the position signals P1 and P2 and the reference pulse RI can be selected as an invalid status combination for transmitting a warning signal, for example the combination [[P1=Low] OR [P2=Low]], when the reference pulse RI is transmitted during normal operations at [P1=P2=High].

In a preferred embodiment, an input side of the logic unit is connected with:

1) a position signal generating unit, which generates the incremental phase-shifted position signals P1, P2, from the scanning signals of the incremental graduation of the scale graduation and sends them to the logic unit;

2) a reference pulse generating unit, which detects the reference markers of the scale graduation and forms a rectangular-shaped basic reference pulse from the resulting analog reference pulse signal and sends it to the logic unit; and 3) a monitoring unit which, when detecting a malfunction state, generates a basic warning signal and sends it to the logic unit, the logic unit logically interconnects the position signals P1 and P2 with the basic reference pulse RI' and emits a reference pulse RI if the condition

[RI'=High] AND [[P1 OR P2]=High]

has been met, logically interconnects the position signals P1, P2 with the basic warning signals WRN' and outputs a warning signal WRN if the condition

[WRN'=High] AND [P1=P2=Low]

has been met.

Since the logic unit determines the valid status combinations from the logical interconnection of the position signals with the basic reference pulses to form reference pulses, and this logical interconnection is known to the program of the evaluation unit, the evaluation unit recognizes a malfunction state when a signal appears during an invalid status combination and can trigger a pre-programmed reaction, for example the immediate stoppage of the machine.

This form of information transfer from the position measuring arrangement to the evaluation unit can be refined in that, if a warning signal which exceeds a predetermined signal length is transmitted, the machine is stopped without delay, while with a warning signal of a signal length which is less than the predetermined signals length, only an optical and/or acoustic signal is triggered which, if required, is coupled with a display indicating the cause of the malfunction and corresponding to the respective signal length.

On the output side of the logic unit, the logic unit is connected with the input of a reference pulse driver component or of a differential driver.

On the input side of the malfunction recognition unit, the malfunction recognition unit is connected with outputs of signal receivers, or respectively differential signal receivers, of the evaluation unit for the phase-shifted, incremental position signals and reference pulses, and on the output side with a signal output unit.

Depending on whether a single-phase transmission or a differential transmission of the position signals and reference pulses is provided between the position measuring arrangement and the evaluation unit, at least three signal transmission lines are arranged between the position measuring arrangement and the evaluation unit, on which two phase-shifted incremental position signals and one reference pulse, which is logically interconnected with the incremental position signals, can be transmitted from the position measuring arrangement to the evaluation unit, or at least six signal transmission lines are arranged, on which two phase-shifted incremental position signals, as well as two phase-shifted incremental position signals, which are inverted in regard to them, and respectively one reference pulse, logically interconnected with the phase-shifted incremental position signals, and with phase-shifted incremental position signals which are inverted in regard to them, can be transmitted from the position measuring arrangement to the evaluation unit.

In order to be able to transmit a warning signal, even in case of a slow advance and during the stoppage of the machine, although the status combination of the position signals P1=0 AND P2=0, required for transmission of the warning signal during normal operations for issuing the reference pulse RI, does not appear, the logic unit contains a time stage, which is initiated at the appearance of the status combination which is invalid for transmitting the reference pulse, and after a preset time interval sends a signal to a first input of an AND member, whose second input can be charged with a warning signal and which sends an alarm signal to the evaluation unit if a signal is present at the two inputs of the latter. For transmitting the alarm signal, the status combination which is invalid for transmitting the reference pulse is forced, and the alarm signal is transmitted like a warning signal. By an acknowledgement of the alarm signal transmitted as a warning signal on the part of the evaluation unit, possibly following the correction of the malfunction state, the control returns into the normal state.

It is intended by exemplary embodiments represented in the drawings to explain the concept on which the present invention is based and further characteristics and variants of the present invention.

DETAILED DESCRIPTION OF THE PREFERRED EMBODIMENTS

Figure 1:
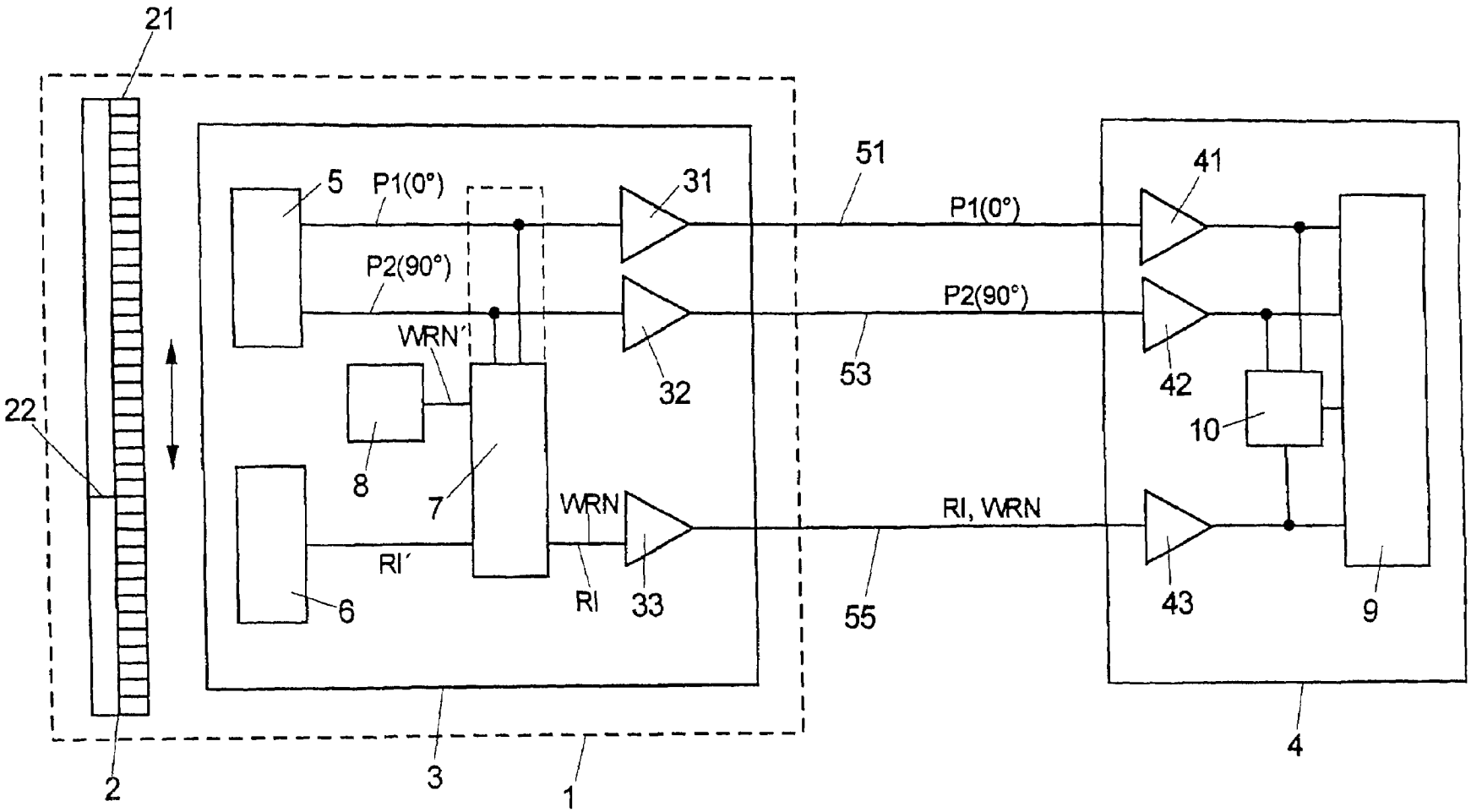
FIG. 1 is a schematic block wiring diagram of an embodiment of a position measuring arrangement in accordance with the present invention, which is connected with an embodiment of an evaluation unit in accordance with the present invention via three signal transmission lines for a single-phase transmission.

FIG. 1 shows a block wiring diagram of a position measuring system, having a position measuring arrangement 1 including a scale graduation 2 and a scanning unit 3, which can be moved relative to the latter. Position signals P1, P2 and a reference pulse RI, which is logically interconnected to the position signals P1, P2, are generated by the position measuring arrangement 1 and are transmitted via signal transmission lines 51, 53, 55 to an evaluation unit 4. For example, the scale graduation 2 and the scanning unit 3 are connected with parts of a machine tool which are movable in relation to each other and whose relative position to each other is to be determined, while the evaluation unit 4 includes a numerical machine tool control, for example, or is integrated in it.

Alternatively to the exemplary embodiment represented in FIG. 1 of a linear movement of the parts which are movable in relation to each other, the attainment of one of the objects in accordance with the present invention can also be employed in connection with position measuring systems in which the parts which are movable with respect to each other perform rotary movements.

The scale graduation 2, for example in the form of a glass scale, contains an incremental graduation 21 of a preset graduation period, as well as reference markers 22. The generation of the position signals P1, P2 and of the reference pulse RI can take place by the employment of optical or photoelectrical, magnetic, inductive or capacitive scanning principles, along with a corresponding design of the scale graduation 2 and the scanning unit 3. For example, in case of the employment of a photoelectrical measuring principle using a transmitted light method, the scale graduation can include a glass scale with a line graduation as the incremental graduation and reference marker, to which a scanning plate is assigned at a short distance from the glass scale. A parallel light beam generated by a semiconductor light source projects a plurality of scanning fields of the scanning plate onto the glass scale, behind which photodiodes, assigned to the scanning fields, are arranged. Since the graduation of the scanning fields is the same as the one on the glass scale and is aligned parallel with it, the light beam passing through is modulated in case of a relative movement between the glass scale and the scanning plate, which is converted in the photodiodes because of the light intensity which varies as a result of light-impermeable lines on the glass scale into a corresponding electrical current. The signals from the photodiodes can be phase-shifted by a mutual offset of the scanning fields. These signals can be converted into rectangular signals by switches, known per se.

Alternatively, when employing the photoelectrical measuring principle, it is possible to use a reflection or incident light method, where the scale is made of a non-transparent material, to which the graduation made of a highly reflective material has been applied.

The scanning unit 3 contains a position signal generating unit 5, which emits two incremental signals, phase-shifted by 90°, as the position signals P1, P2, and a reference pulse generating unit 6, which forms a rectangular-shaped basic reference pulse RI' from a reference marker 22 detected by the scanning unit 3 and the analog reference pulse signal resulting therefrom.

When applying the photoelectrical measuring principle, the position signal generating unit 5 and the reference pulse generating unit 6 include several light sources, scanning structures on the scale graduation 2, as well as optoelectronic detector elements.

In case of a relative movement between the scale graduation 2 and the scanning unit 3, the two position signals P1, P2 phase-shifted by 90° are emitted from the position signal generating unit 5 during the one-phase transmission represented in FIG. 1 in parallel form to two downstream-arranged first and second driver components 31, 32, whose outputs are connected via two signal transmission lines 51, 53 with the inputs of respectively one signal receiver 41, 42 of the evaluation unit 4.

The reference pulse RI is formed in the logic unit 7 by a logical interconnection of the basic reference pulse RI', emitted by the reference pulse generating unit 6, and the two position signals P1, P2 phase-shifted by 90° and embodied as rectangular pulses, when these are at high potential, or respectively are logically High, i.e. if the condition $$RI'=\text{High AND } [P1 \text{ OR } P2=\text{High}]$$

has been met. The reference pulse RI created in this way is transmitted from the logic unit 7 via a driver component 33 and a signal transmission line 55 to a signal receiver 43 of the evaluation unit 4. Simultaneously, the logic unit 7 hereby fixes the valid status combination during the transmission of the reference pulse RI.

Figure 2:
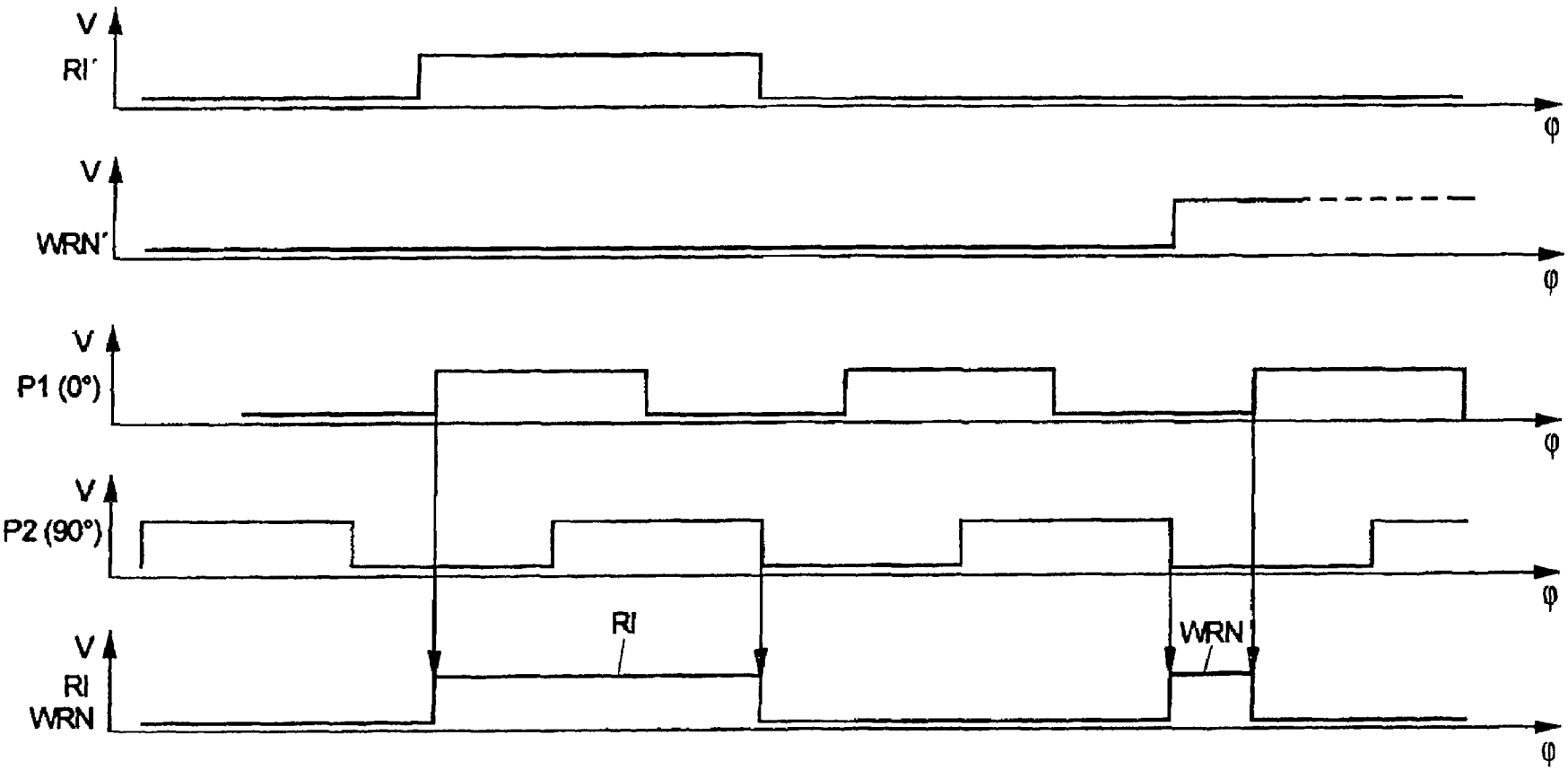
FIG. 2 represents possible pulse diagrams for the position measuring arrangement and evaluation unit of FIG. 1 of a basic reference pulse, a basic warning signal, two incremental position signals, phase-shifted by 90° with respect to each other, and a reference pulse, formed by logically interconnecting the basic reference pulse with the incremental position signals, as well as a warning signal output during a status combination which during normal operations is invalid for issuing the reference pulse.

FIG. 2 shows, from top to bottom, pulse diagrams of the basic reference pulse RI', the basic warning signal WRN', the two incremental position signals P1 and P2, phase-shifted by 90° and embodied as rectangular pulses, as well as the reference pulse RI, formed by means of the previously described logical interconnection of the basic reference pulse RI' with the position signals P1 and P2 over the phase angle ϕ.

From the logical interconnection of the basic reference pulse RI' with the phase-shifted incremental position signals P1, P2, the condition

[RI=High] AND [P1 OR P2=High]

results on the signal transmission line 55 as the valid status combination for transmitting the reference pulse RI.

A status combination which, under normal operations, or respectively in the malfunction-free state of signal generation, is invalid for outputting the reference pulse RI, therefore results in case of a deviation from the above condition. This status combination of the position signals P1, P2 and the reference pulse RI, which is invalid for outputting the reference pulse RI, is used by the present invention for transmitting a warning signal WRN, so that a warning state is detected by the evaluation unit 4 if a signal is transmitted during the status combination

[RI=High] AND [P1=P2=Low]

which is invalid for outputting the reference pulse RI.

Upon the detection of a malfunction state, for example when signal amplitudes go below a limit, a monitoring unit 8, arranged in the scanning unit 3, or connected with it, outputs a basic warning signal WRN' to the logic unit 7, which is connected on the input side with the outputs of the position signal generating unit 5, as well as with the output of the reference pulse generating unit 6. By the logical interconnection of the position signals P1, P2 with the basis reference pulse RI', the logic unit 7 determines the status combinations of the position signals P1, P2 and the reference pulse RI which are valid and those invalid for outputting the reference pulse RI. In the presence of a status combination which, during normal operations, is invalid for outputting the reference pulse RI and of a basic warning signal WRN' present at its connection with the monitoring unit 8, the logic unit 7 outputs a rectangular-shaped warning signal WRN in accordance with FIG. 2 when the condition [WRN'=High] AND [P1=P2=Low] has been met. The rectangular-shaped warning signal WRN is output to the evaluation unit 4 via the further driver component 33 and the signal transmission line 55 for the reference pulse RI.

In addition to the signal receivers 41, 42, 43, the evaluation unit 4 includes a malfunction recognition unit 10, whose input is connected with the outputs of the signal receivers 41, 42, 43, and which is connected at the output side with a signal output unit 9. The signal output unit 9 is connected, for example, with a numerical machine tool control, or is integrated into it, and has a monitor, or is respectively connected with the optical and/or acoustic signal sensors.

The malfunction recognition unit 10 is used for the detection of valid status combinations and for those which are invalid for outputting the reference pulse RI of the position signals P1, P2 and the reference pulse RI and, in case of a warning signal WRN' appearing within the time interval of a status combination invalid for outputting the reference pulse RI, outputs a warning signal WRN to the signal output unit 9 of the evaluation unit 4, which outputs a suitable optical and/or acoustic signal, or respectively intervenes in the numerical machine tool control.

The block wiring diagram represented in FIG. 1 is substantially used for explaining the functional connection during detection, generation and transmission of the position signals P1 and P2, the basic reference pulse RI', the reference pulse R1, the basic warning signal WRN' and the warning signal WRN. It is, however, possible to configure the individual components of the position measuring arrangement 1 and the evaluation unit 4 and to link them with each other differently from the exemplary embodiment represented in FIG. 1. For example, it is thus possible to integrate the reference pulse generating unit 6 into the logic unit 7, which additionally monitors the signal amplitudes of the scanning signals and reference markers, in order to detect if the signal amplitudes go below a limit in order to output a malfunction report. It is possible in the same way to integrate the malfunction recognition unit 10 into the signal output unit 9 by appropriate logic components.

Figure 3:
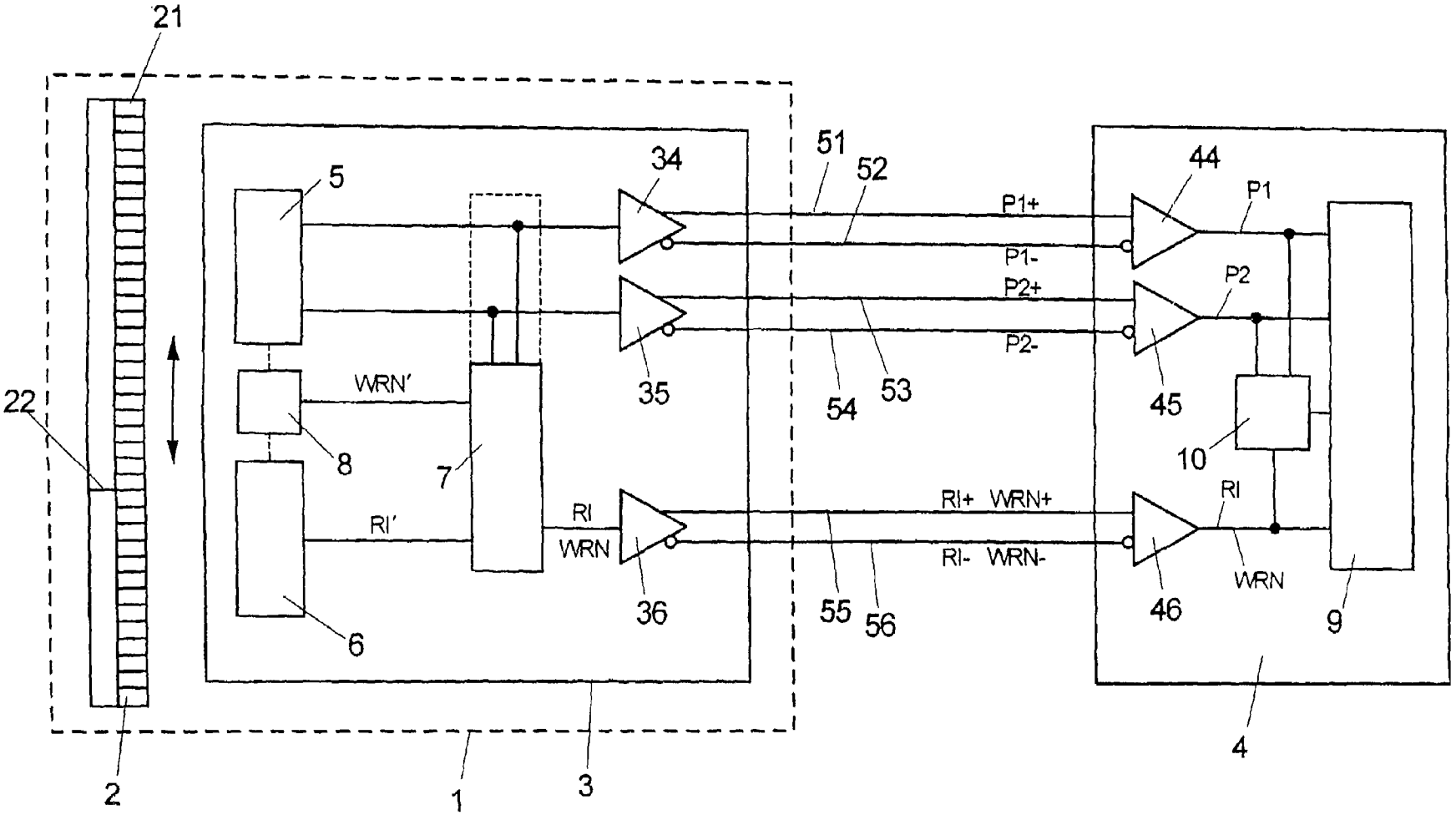
FIG. 3 is a schematic block wiring diagram of a second embodiment of a position measuring arrangement in accordance with the present invention, which is connected with an embodiment of an evaluation unit in accordance with the present invention via six signal transmission lines for a differential signal transmission.

It is of course also possible to use the attainment of an object of the present invention in a position measuring system with differential signal transmission. An exemplary embodiment of this is represented in FIG. 3 in the form of a schematic block wiring diagram, which substantially agrees with the block wiring diagram of a position measuring system with a single-phase transmission in FIG. 1, so that reference is made to this extent to the above explanation.

In this exemplary embodiment the incremental signals, which are generated by the position signal generating unit 5 and are phase-shifted by 90°, are output as position signals P1, P2 to downstream-connected first and second differential drivers 34, 35, which generate position signals P1+, P2+, as well as position signals P1−, P2− which are inverted with respect to the latter, from the two position signals P1, P2, and transmit these in a parallel form over a total of four signal transmission lines 51 to 54 to first and second differential receivers 44, 45 of the evaluation unit 4. Thus, in case of a relative movement between the scale graduation 2 and the scanning unit 3, the position measuring arrangement 1 provides two incremental signals, phase-shifted by 90°, as well as an inverted incremental signal for each of the two phase-shifted incremental signals, which is also transmitted for further processing to the evaluation unit 4 via the signal transmission lines 51 to 54.

The generation of a basic reference pulse RI' takes place in a known manner by the reference signal generating unit 6 in the same way in one or several known relative positions of the scale graduation 2 and the scanning unit 3. As described above in connection with the description of the switching arrangement in accordance with FIG. 1, the basic reference pulse RI' is logically interconnected to the downstream-connected logic unit 7 with the position signals P1, P2 to form the reference pulse RI and is forwarded to a downstream-connected third differential driver 36 of the scanning unit 3, which generates a reference pulse RI+, as well as a reference pulse RI− inverted with respect to it, from the reference pulse RI. Both reference pulses RI+ and RI− are transmitted via signal transmission lines 55, 56 to the inputs of a third differential receiver 46 of the evaluation unit 4, which outputs the reference pulse RI formed from the reference pulse RI+ and the inverted reference pulse RI− at its output to the signal output unit 9, or respectively the malfunction recognition unit 10, of the evaluation unit 4.

The monitoring unit 8 is connected with the position signal unit 5 and the reference pulse generating unit 6 for picking up the signal amplitudes, and/or with a unit indicating a malfunction state and, when signal amplitudes go below a limit, for example, from its output it sends a basic warning signal WRN' to the logic unit 7 which, in case of a status combination of the position signals P1+, P1−, P2+, P2− and reference pulses RI+, RI−

[RI=High] AND [P1=P2=Low], which during normal operations is invalid for outputting the reference pulse RI, outputs a warning signal WRN+, WRN− over the signal transmission lines 55, 56 for the reference pulses RI+, RI− to the evaluation unit 4.

Thus, in case of a single-phase transmission, as well as of a differential signal transmission, the attainment of an object of the present invention makes possible the transmission of a warning signal WRN, or respectively WRN+, WRN−, from the position measuring arrangement 1 to the downstream-arranged evaluation unit 4 by means of the exclusive use of the existing signal transmission lines 51 to 56, so that no additional wiring outlay is required. Moreover, compatibility with the number of existing connections between the position measuring arrangement 1 and the evaluation unit 4 is assured, and the warning signal WRN, or respectively the warning signals WRN+, WRN−, can be transmitted in the warning state together with the continued transmission of the position signals P1, P2, P1+, P1−, P2+, P2− and of the reference pulses RI, RI+, RI−, so that the machine controlled by the position measuring system need not be immediately stopped in case of the occurrence of a warning state.

It can occur in case of a slow advance and during a stoppage of the parts of the machine which are movable in relation to each other, for example during the stoppage of a shaft of a machine tool at a defined position, that there is no possibility of outputting a warning signal over a prolonged period of time, because the state P1=0 AND P2=0 does not occur.

In order to be able to output a warning to the evaluation unit 4 in this state, too, in particular if a malfunction state exists which makes the immediate stoppage of the machine necessary, a time stage is provided in the logic unit 7, which is initiated in case of the event P1=P2=Low and which, after a preset length of time, outputs a signal to a first input of an AND member, whose second input can be charged with the warning signal which is output by the monitoring unit 8, and which outputs an alarm signal to the evaluation unit 4 if a signal is present at both inputs.

Following a RESET of the evaluation unit 4 following the correction of the malfunction state and acknowledgement of the alarm report, the normal, above described control can be continued, possibly with a transmission of warning signals.

The foregoing description is provided to illustrate the invention, and is not to be construed as a limitation. Numerous additions, substitutions and other changes can be made to the invention without departing from its scope as set forth in the appended claims.

We claim:

1. A method for transmitting signals from a position measuring arrangement to an evaluation unit, the method comprising:

transmitting substantially rectangular-shaped position signals, substantially rectangular-shaped reference pulses, and warning signals indicating a malfunction state from a position measuring arrangement for determining the position of two elements of a machine which are movable relative to each other, to an evaluation unit;

logically interconnecting said reference pulses with said position signals in such a way that, in a malfunction-free state, a valid status combination for outputting said reference pulses and an invalid status combination for outputting said reference pulses appear in each period; and transmitting warning signals indicating a malfunction state during said invalid status combination of said position signals and said reference pulses which, in said malfunction-free state, is invalid for outputting said reference pulses.

2. The method in accordance with claim 1, wherein said warning signals are transmitted on signal transmission lines containing one or more of said reference pulses.

3. The method in accordance with claim 1, wherein said position signals are incremental, phase shifted and generated from scanning signals of an incremental graduation of a scale graduation of said position measuring arrangement;

reference pulse signals are analog and derived from reference markers of said scale graduation, and said reference pulses are are formed so that, when a malfunction state is detected, a basic warning signal is generated, that, for a valid status combination, two of said position signals (P 1, P2) and said basic reference pulses (RI') are logically interconnected in accordance with a first condition defined by

[RI'=High] AND [[P1 OR P21 =HIGH], and that, when a second condition defined by

[WRN' =HIGH] AND [P 1 =P2 =Low]

has been met, said two of said position signals are logically interconnected with said basic warning signal (WRN') and a warning signal is output.

4. The method in accordance with claim 1, wherein a single-phase transmission of two of said position signals that are phase-shifted with respect to each other and one of said reference pulses which, during malfunction-free operations, is logically interconnected to form periodically occurring valid status conditions.

5. The method in accordance with claim 1, wherein a differential transmission of at least four of said position signals is performed, wherein two of said at least four of said position signals are phase-shifted by 90° with respect to each other, and another two of said at least four of said position signals are inverted with respect to said two of said at least four of said position signals, and respectively one first reference pulse signal which, during malfunction-free normal operations, is logically interconnected with said two of said at least four of said position signals to form periodically occurring valid status combinations, and respectively a second reference pulse signal which, during malfunction-free normal operations, is logically interconnected with said another two of said at least four of said position signals to form periodically occurring valid status combinations.

6. The method in accordance with claim 1, wherein, in case of a slow advance or during stoppage of said machine a time is determined which has elapsed since a last appearance of said invalid status combination which is invalid for transmitting said reference pulses, and when a predetermined period of time is exceeded and when one of said warning signals indicating a malfunction state appears, an alarm signal is transmitted in a forced manner to said evaluation unit.

7. The method in accordance with claim 6, wherein said invalid status combination, which is invalid for transmission of said reference pulses, is forced for transmitting said one of said warning signals, and said alarm signal is transmitted like a warning signal.

8. The method in accordance with claim 6, wherein when a warning signal is received, said evaluation unit requests an acknowledgement before it returns to normal control operations.

9. The method in accordance with claim 7, wherein when a warning signal is received, said evaluation unit requests an acknowledgement before it returns to normal control operations.

10. A device for transmitting substantially rectangular-shaped position signals and reference pulses, as well as warning signals indicating a malfunction state, from a position measuring arrangement to an evaluation unit, the device comprising:

a position measuring arrangement that determines a position of two elements of a machine which are movable relative to each other, said position measuring arrangement comprising:

a scale graduation comprising an incremental graduation and reference markers, wherein scanning signals are generated from said incremental graduation;

a logic unit which outputs substantially rectangular-shaped phase-shifted, incremental position signals from said scanning signals and which generates a substantially rectangular-shaped reference pulse from said reference markers and said position signals in such a way that, in the malfunction-free state, valid status combinations and invalid status combinations for issuing said reference pulses occur in each period;

an evaluation unit that receives said position signals and said reference pulse from a signal transmission of said position measuring arrangement, wherein said logic unit inserts a warning signal into said signal transmission indicating a malfunction state during a status combination of said position signals and of said reference pulse which, in a malfunction-free state, is invalid for issuing said reference pulse, wherein said evaluation unit comprises a malfunction recognition unit which filters a warning signal, which was transmitted during a status combination of said position signals and said reference pulse which is invalid for an output of said reference pulse in said malfunction-free state, out of said signal transmission.

11. The device in accordance with claim 10, wherein a condition

[RI=High] AND [P1=P2=Low]

applies as invalid status combination of two of said position signals (P1, P2) and of said reference pulse (RI).

12. The device in accordance with claim 10, wherein said logic unit has an input side that is connected with:

1) a position signal generating unit, which generates said incremental phase-shifted position signals from said scanning signals and sends them to said logic unit;

2) a reference pulse generating unit, which detects said reference markers and forms a rectangular-shaped basic reference pulse from a resulting analog reference pulse signal and sends said analog reference pulse signal to said logic unit;

3) a monitoring unit which, when detecting a malfunction state, generates a basic warning signal and sends said basic warning signal to said logic unit;

wherein said logic unit logically interconnects two of said position signals (P1, P2) with said basic reference pulse (RI') and emits said reference pulse if the condition

[RI'=High] AND [[P1 OR P2]=High]

has been met, and that said logic unit logically interconnects said two of said position signals with said basic warning signals (WRN') and outputs a warning signal (WRN) if the condition

[WRN'=High] AND [P1=P2=Low]

has been met.

13. The device in accordance with claim 10, wherein on an output side of said logic unit is connected with an input of a reference driver component or a differential driver.

14. The device in accordance with claim 10, wherein on an input side of a malfunction recognition unit is connected with outputs of signal receivers of said evaluation unit, or respectively differential signal receivers of said evaluation unit for said phase-shifted, incremental position signals and reference pulses, and on an output side of said malfunction recognition unit with a signal output unit.

15. The device in accordance with claim 10, wherein at least three signal transmission lines are arranged between said position measuring arrangement and said evaluation unit, on which said position signals and said reference pulses, or respectively, during said status combination which is invalid for outputting said reference pulses in said malfunction-free state, said warning signal indicating a malfunction state, can be transmitted from said position measuring arrangement to said evaluation unit.

16. The device in accordance with claim 10, wherein between said position measuring arrangement and said evaluation unit at least six signal transmission lines are arranged, on which two of said phase-shifted incremental position signals, as well as two other phase-shifted incremental position signals, which are inverted in regard to them, and respectively a first reference pulse and a second reference pulse inverted with respect to it, or respectively, during said status combination which in said malfunction-free state is invalid for outputting said first and second reference pulses, a first set of warning signals indicating a malfunction state and a second set of warning signals inverted in regard to said first set of warning signals, can be transmitted from said position measuring arrangement to said evaluation unit.

17. The device in accordance with claim 10, wherein said logic unit comprises a time stage, which is initiated at an appearance of said status combination which is invalid for transmitting said reference pulse, and after a preset time interval sends a signal to a first input of an AND member, wherein a second input of said AND member can be charged with said warning signal and outputs an alarm signal if a signal is present at said first and second inputs of said AND member.

18. The device in accordance with claim 17, wherein, for transmitting said alarm signal, said status combination which is invalid for transmitting said reference pulse is forced, and said alarm signal is transmitted like a warning signal.

* * * * *